US005897926A

United States Patent [19]

Mikulas

[11] Patent Number: 5,897,926

[45] Date of Patent: Apr. 27, 1999

[54] CONNECTED DECORATIVE GRASS

[76] Inventor: Christine Marie Mikulas, 235 Silver Springs Dr., Colorado Springs, Colo. 80919

[21] Appl. No.: 08/780,704

[22] Filed: Jan. 8, 1997

[51] Int. Cl.[6] ..... A41G 1/00; D02G 1/00

[52] U.S. Cl. ..... 428/17; 273/DIG. 13; 426/104

[58] Field of Search ..... 428/7, 17; 426/104; 273/DIG. 13

[56] References Cited

U.S. PATENT DOCUMENTS

| | | | |
|---|---|---|---|
| 3,429,019 | 2/1969 | Linstead | 28/147 |
| 3,560,313 | 2/1971 | Herkimer | 428/4 |
| 3,587,946 | 6/1971 | Christensen | 223/46 |
| 3,780,514 | 12/1973 | Rodermund et al. | 428/10 X |
| 3,922,407 | 11/1975 | Nimmo, Jr. et al. | 428/5 |
| 4,199,627 | 4/1980 | Weder et al. | 428/17 X |
| 4,292,266 | 9/1981 | Weder et al. | 264/140 |
| 4,401,700 | 8/1983 | Weder et al. | 428/17 |
| 4,418,103 | 11/1983 | Tani et al. | 428/4 |
| 4,496,614 | 1/1985 | Weder et al. | 428/17 X |
| 4,514,453 | 4/1985 | Bussey, Jr. | 428/159 |
| 4,529,636 | 7/1985 | Olson | 428/43 |
| 4,539,237 | 9/1985 | Clayton | 428/43 X |
| 4,549,908 | 10/1985 | Weder et al. | 428/17 X |
| 4,776,521 | 10/1988 | Weder et al. | 241/30 |
| 4,884,682 | 12/1989 | Weder et al. | 206/83.5 |
| 4,961,375 | 10/1990 | Weder et al. | 100/45 |
| 5,020,672 | 6/1991 | Watts | 428/17 X |
| 5,038,975 | 8/1991 | Weder et al. | 222/56 |
| 5,111,741 | 5/1992 | Weder et al. | 100/45 |
| 5,134,013 | 7/1992 | Parker | 428/182 |
| 5,154,964 | 10/1992 | Iwai et al. | 428/156 |
| 5,601,886 | 2/1997 | Ishikawa et al. | 428/17 |

*Primary Examiner*—Henry F. Epstein
*Attorney, Agent, or Firm*—Linda Flewellen Gould

[57] ABSTRACT

Although typical decorative grass is useful for lining containers such as Easter baskets to provide an attractive and cushioned nest, such decorative grass has the disadvantage of creating messes wherever individual strands of the grass fall. When individual strands which constitute decorative grass are connected to one another, this significantly cuts down on or eliminates the mess usually associated with decorative grass. The individual strands may be connected at one end of each strand, or at the middle of the strands. The strands may also be connected to the container in which the decorative grass is placed.

14 Claims, 6 Drawing Sheets

CONNECTED DECORATIVE GRASS

RELATED FILINGS

This application is related to Document Disclosure 368157 filed on Jan. 9, 1995.

BACKGROUND OF THE INVENTION

TECHNICAL FIELD

This invention pertains to decorative grass in which each of the individual strands which comprise the decorative grass are connected, to avoid individual strands falling out and littering.

BACKGROUND ART

Decorative grass, commonly referred to as "Easter grass", is frequently used to line baskets or other containers to create a cushioned and ornamental nest. The decorative grass nest makes such a container more attractive, and may also serve as a support for candy or colored "Easter eggs". Decorative grass presently known in the prior art is constructed of thin strands of material. The material may be selected from a number of possibilities, including plastic, plastic-like, metallic, paper, organic polymers such as polystyrene or polypropylene, and cellophane. Frequently, each strand has a thickness of less than one fifth of a millimeter, and a width of less than six-millimeters. It is taught in U.S. Pat. Nos. 4,961,375, 5,111,741, and 4,884,682 that each strand of decorative grass is typically between three and twenty inches in length.

As any parent who has given an "Easter basket" to a small child will testify, decorative grass tends to create a mess wherever the basket goes. If the child carries the basket from room to room searching for Easter eggs to deposit in the basket, each room will undoubtedly become the depository of a few strands of decorative grass during the hunt. It is not uncommon to find individual strands of decorative grass hiding in remote areas of carpet and tangled in plants or coats several months after the original basket containing the decorative grass has been put away for next year.

A method of connecting the individual strands of decorative grass to each other, or to the container in which they are placed, has the distinct advantage of avoiding the mess associated with typical decorative grass.

Various types of decorative grass are known in the prior art. For example, U.S. Pat. Nos. 4,199,627, 4,292,266, 4,549,908, 4,401,700, and 4,496,614, all to Weder et al., each describe decorative grass with particular qualities. However, the decorative grass described in each of these patents consists of unconnected strands of material which can become separated, fall out of the original container, and create a mess. U.S. Pat. Nos. 5,111,741, 4,884,682, and 4,961,375, all to Weder et al., describe a system for baling "Easter grass". However, even in the baled form, individual strands are not connected and can create litter.

U.S. Pat. Nos. 5,038,975 and 4,776,521, each to Weder et al., concern a process for removing uniform charges of decorative grass from a bale of the material. Because the "bales of Easter grass are comprised of loosely interconnected flakes of compacted filaments . . . the flakes tend to separate . . . [and] there is a tendency for the flakes to drop one-by-one or, at most, in a group of several flakes . . . " U.S. Pat. No. 4,776,521 at columns 6–7.

A folding and crimping apparatus is described in U.S. Pat. No. 5,134,013 to Parker. This device is designed to fold and crimp shredded strips of sheet material, such as decorative grass, to create a woven bunch of such strips. Once again, the various strips are not connected to each other, so it is possible for individual strips to be pulled out or to fall out of the woven bunch.

It is anticipated that decorative grass is an art significantly different from the manufacture of wreaths, rosettes, and pompon bows, so that patents describing the manufacture of these distinct products are not an appropriate indicator of the level of ordinary skill in the art to which the claimed invention pertains. Wreaths, rosettes, and pompon bows are used in a variety of manners, none of which includes lining baskets or containers. Furthermore, these devices are customarily constructed of ribbon which is wider, thicker, and easier to connect to itself than the thin strands of material used to produce decorative grass. For example, U.S. Pat. No. 3,922,407 to Nimmo, Jr. et al. and U.S. Pat. No. 3,587,946 to Christensen describe methods of producing pompon bows from a continuous single strip of ribbon material. U.S. Pat. No. 3,780,514 to Rodermund et al. teaches the use of an apparatus to manufacture artificial decorative evergreen. U.S. Pat. No. 3,429,019 to Linstead and U.S. Pat. No. 3,560,313 to Herkimer each concern the making of pompons. Linstead describes a process that involves two lengths of yarn, while Herkimer teaches the construction of a pompon from multiple strips of crepe paper or similar substance, each of which strips is mounted at its end on a rectangular edge band.

While each of these products is useful for its intended purpose, none is suitable for being placed in a container to provide an attractive cushioned nest, in such a way that single strands are connected and cannot drop out to create a mess.

DISCLOSURE OF THE INVENTION

SUMMARY OF THE INVENTION

An object of this invention is to provide a new and useful decorative grass product which eliminates the mess typically associated with the use of decorative grass.

Another object of this invention is to provide a decorative grass product which does not tend to disintegrate and loose mass while being used.

Yet another object of this invention is to provide a decorative grass product which does not tend to disintegrate and loose mass while being produced, packaged, shipped, and marketed.

Decorative grass is frequently used in many settings, including Easter baskets, candy boxes, window displays, and decorative packaging. While decorative grass is easy to arrange and use, because it is made of multiple thin strands of material, individual strands tend to separate from the bulk of the decorative grass. As a result, the decorative grass eventually needs replenishing, as part of the original mass has disappeared. As the nest of decorative grass disintegrates, the consumer experiences a frustrating loss of value. The individual strands which separated from the bulk decorative grass may end up in a variety of inconvenient places, creating an undesirable mess.

The decorative grass product which is claimed herein consists of one or more thin strands of material. A variety of materials may be used to create decorative grass, including paper, plastic, metallic, organic polymers, and cellophane. Frequently each strand is substantially similar in size to all of the other strands in the same bunch of decorative grass, but it would be possible to create decorative grass which consisted of a variety of sizes of strands. For example, it would be possible to have substantially similar strands in terms of width and thickness, while utilizing a variety of lengths in the strands which together form the decorative grass product.

As mentioned above, it is customary in the industry for each individual strand of decorative grass to be no longer than twenty inches. However, in one embodiment of the new and useful improvement of decorative grass which is claimed herein, a single thin strand of material, longer than twenty inches, is crimped and folded onto itself to form a bunch of decorative grass. Because this decorative grass product consists of only a single strand, there are no individual strands which can become separated from the decorative grass. If desired, the single strand can be attached to a basket or other container, at an end of the single strand or at some location between the two ends.

The new and useful improvement of decorative grass claimed herein can also be made from multiple thin strands of material, which strands are attached to each other, either at one end of each strand, or at a point between the ends of the various strands. Numerous attachment options are available. For example, the strands may be attached to one another by an adhesive applied to each strand in the chosen location. If the strands are made of material which becomes sticky upon an application of heat, such as polypropylene, then heat may be applied at an end of each strand or at some location in between the ends, to adhere the individual strands together. A variety of mechanical clamps may be used to attach the strands as well. For example, wire twist ties, rings, bands, straps, staples, or stitches may be used as a clamp to hold the individual strands together. Once again, it is possible for such clamps to be applied at one end of each strand, or at a location between the two ends of each such strand.

It is possible to attach the decorative grass product to the container in which it is to be used, to further secure the individual strands together and to that container. The method of attachment can be adhesion, such as by glue, or mechanical, such as by means of a clamping device. The same attachment method that was used to connect the strands together may be used to attach the strands to the container. Alternatively, two separate attachment methods may be used, one to attach the strands to each other and one to attach the strands to the container. If the container in which the decorative grass is to be used is a woven basket, then it may be advantageous to use a single clamp to snugly fit around each thin strand of material as well as to fit around one of the woven osiers, attaching each strand to that osier.

By connecting the individual strands to each other, and possibly to a container as well, a new and improved decorative grass product is created. This new decorative grass will be welcomed by anyone who has struggled to clean up the individual strands of grass which have dropped from a typical Easter basket. Furthermore, this new and improved decorative grass will provide more value for consumers, as a purchased nest of decorative grass will be unlikely to disintegrate.

The novel features that are considered characteristic of the invention are set forth with particularity in the claims. The invention itself, both as to its construction and its method of operation, together with additional objects and advantages thereof, will best be understood from the description of specific embodiments which follows, when read in conjunction with the accompanying drawings.

DETAILED DESCRIPTION OF THE PREFERRED EMBODIMENT

The present invention concerns a new and improved decorative grass product which is not subject to loss of individual strands.

In the following description, numerous specific details are set forth, in order to provide a thorough understanding of the present invention. It will be obvious, however, to one skilled in the art that the present invention may be practiced without these specific details. Some well-known methods and structure have not been set forth in order not to unnecessarily obscure the description of the present invention.

Figure 1:
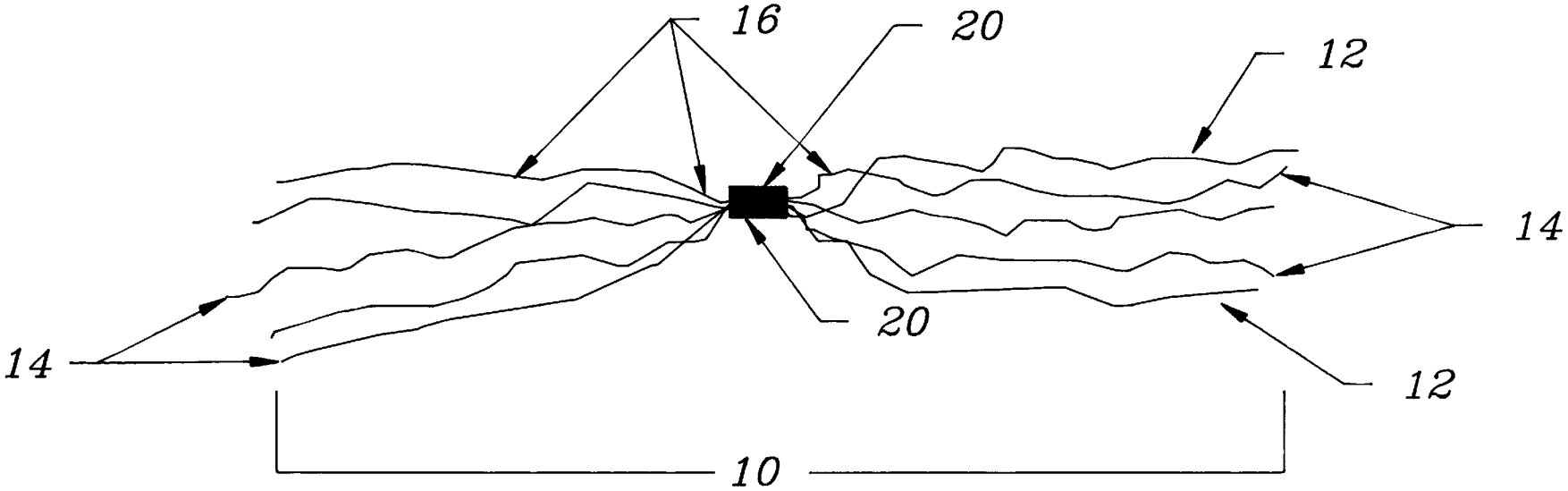
FIG. 1 is a front view of a decorative grass product, according to the present invention.

The decorative grass product of the present invention can be better understood by reference to FIG. 1. The decorative grass product 10 consists of numerous individual strands of material 12. Each individual strand 12 has two ends 14 and a middle section 16. The accompanying drawings attempt to show only a few strands 12 in each Figure, for the sake of simplicity. It will be understood that numerous strands 12 are contemplated in FIGS. 1–6 and 10, although only a few of such strands are shown. The strands 12 may be made of a variety of possible materials, including plastics, paper, metallic compositions, cellophane, or polymers.

Individual strands 12 can be attached to one another by a number of different methods. For example, as shown in FIG. 1, the strands 12 may be bonded to each other by applying glue or other adhesive 20, or by heating the strands 12 at a point 20 to cause those strands to stick to each other. Heating to establish a point of adhesion is possible if the strands 12 are composed of materials which become sticky upon the application of heat, such as polypropylene. The individual strands 12 may be conveniently attached to one another at some point in the middle section 16 of each strand 12, as shown in FIG. 1, or at an end 14, as shown in FIG. 4.

Figure 4:
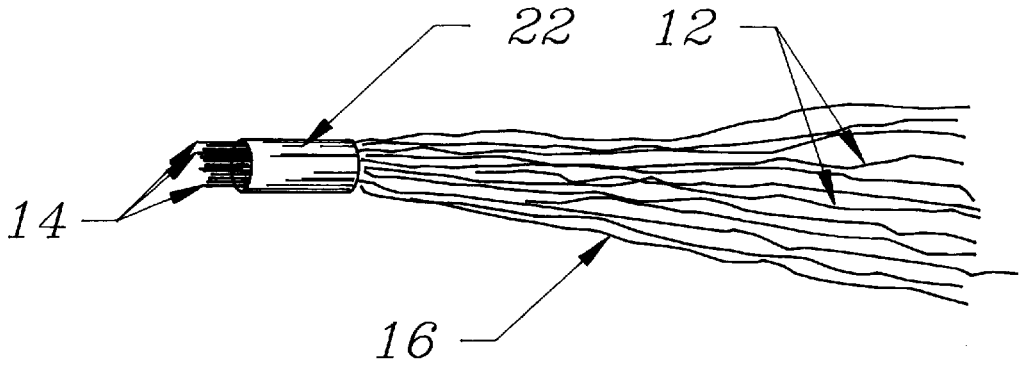
FIG. 4 is a front view of a decorative grass product, according to the present invention.

FIG. 4 demonstrates the use of a mechanical clamping device 22 to attach the individual strands 12 to one another.

Such a clamp 22 may be attached at the end 14 of the strands 12, or could be attached in a middle section 16 of the strands 12. Numerous types of mechanical clamping devices may be utilized, including wire twist ties, staples, stitches, rings, bands, and straps.

Figure 2:
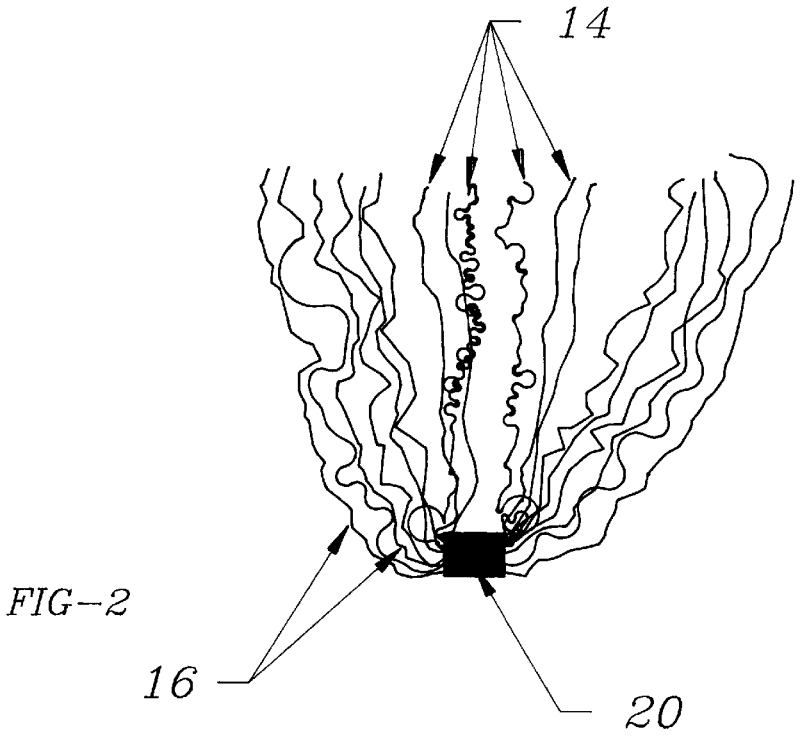
FIG. 2 is a front view of the embodiment of the present invention shown in FIG. 1, with individual strands placed to form a decorative grass nest.
Figure 5:
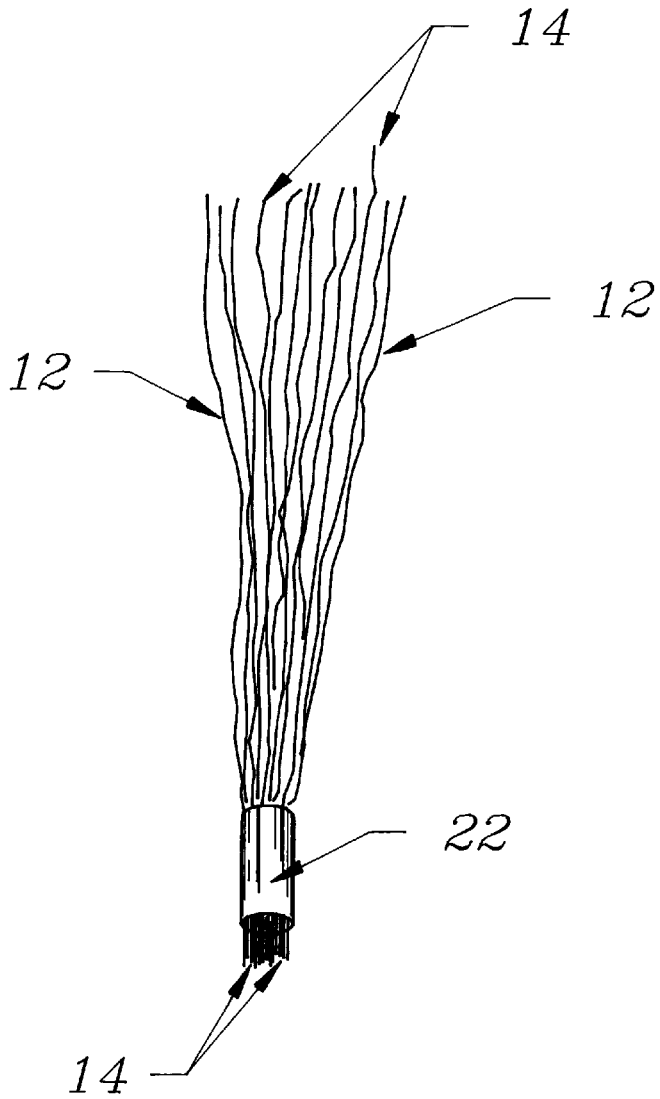
FIG. 5 is a front view of the embodiment of the present invention shown in FIG. 4, with individual strands placed to form a decorative grass nest.

Although it may be more convenient to apply the chosen method of adhesion or mechanical attachment when the strands 12 are elongated as shown in FIGS. 1 and 4, it is a simple matter to then shape the decorative grass 10 into a nest as shown in FIGS. 2 and 5. Advantageously, the adhesive 20 or mechanical clamp 22 can be positioned at the bottom of the nest, so that the ends 14 of individual strands 12 form a cushioned top to the nest.

Figure 3:
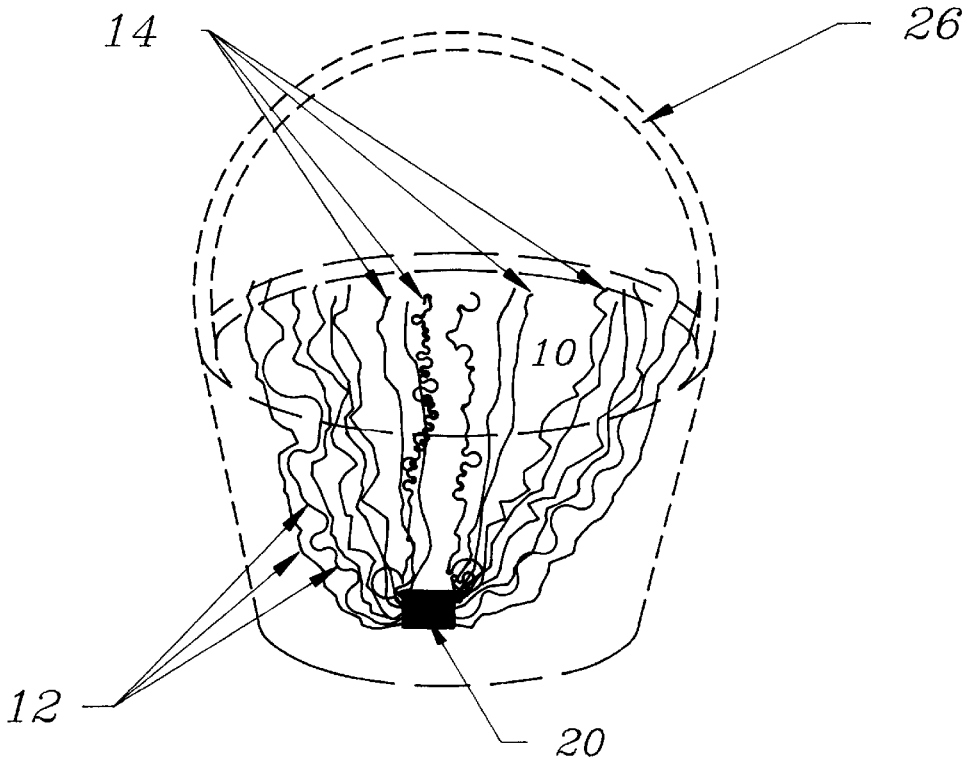
FIG. 3 is a cut-away view of a decorative grass product attached to a basket container, according to the present invention.
Figure 6:
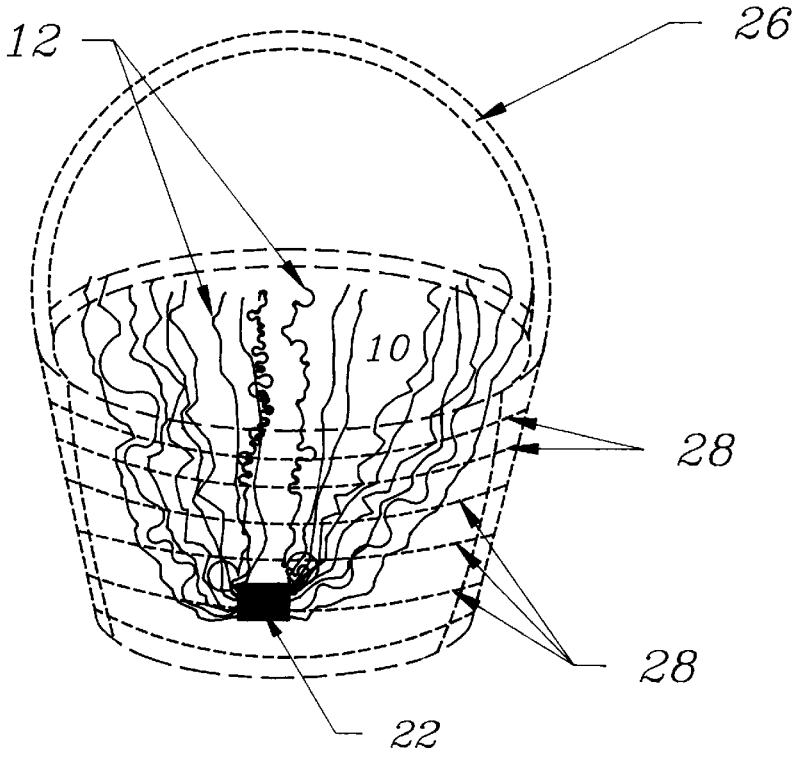
FIG. 6 is a cut-away view of a decorative grass product attached to a basket container, according to the present invention.

Since decorative grass 10 is frequently used in containers such as Easter baskets, it may be convenient to attach the individual strands 12 directly to a container 26. As shown in FIG. 3, the decorative grass 10 may be glued or otherwise secured by an adhesive 20 to the container 26. Similarly, as shown in FIG. 6, the mechanical clamp 22 which fits snugly around the individual strands 12 may also fit around a component of the container 26, serving the dual purpose of holding the strands together and attaching them to the container. If the container is a basket comprised of woven osiers, then a clamp 22 such as a metal twist tie can be fit around the individual strands 12 and an osier 28, then secured tightly so that no individual strand 12 can come loose from the osier 28.

Figure 10:
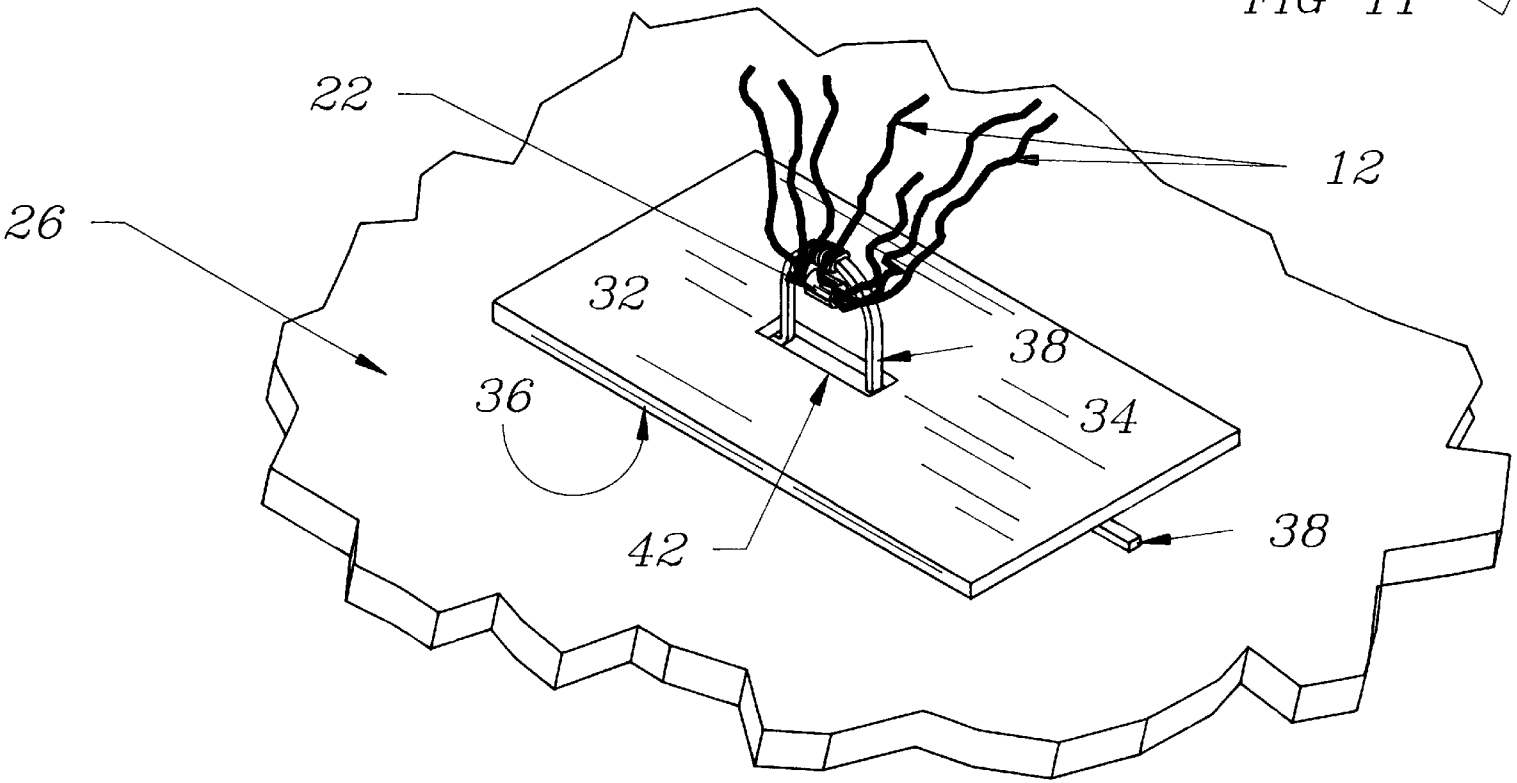
FIG. 10 is a cut-away view depicting a method of attaching a decorative grass product to a container, according to the present invention.

Another convenient embodiment of the present invention is shown in FIG. 10. Each of the strands 12 is held together by a clamp 22. A separate container attachment 30 is used to connect the strands 12 to the interior of the container 26. The container attachment 30 may conveniently consist of a pad 32, having a top 34 and a bottom 36, and a tie 38. If desired, an adhesive substance may be applied to the top 34 of the pad 32, to cause individual strands 12 to be held at various points on the pad 32, holding the strands 12 in desirable locations to create a fluffy, spread out nest. Similarly, an adhesive may be applied to the bottom 36 of the pad 32, to cause the container attachment 30 to bond to the container 26. In this embodiment, it is advantageous to cause the tie 38 to have numerous projecting edges 40, to engage various strands 12, both holding those strands 12 and causing them to spread out from one another. Once the tie 38 is pulled tightly through a slit 42 in the pad 32, the strands 12 and clamp 22 are held tightly against the pad 32, while the pad 32 is attached to and held flush with the container 26. If the container 26 is a basket, then the tie 38 may be pulled through the bottom of the container so that the tie 38 is secured around an osier 28.

Figure 7:
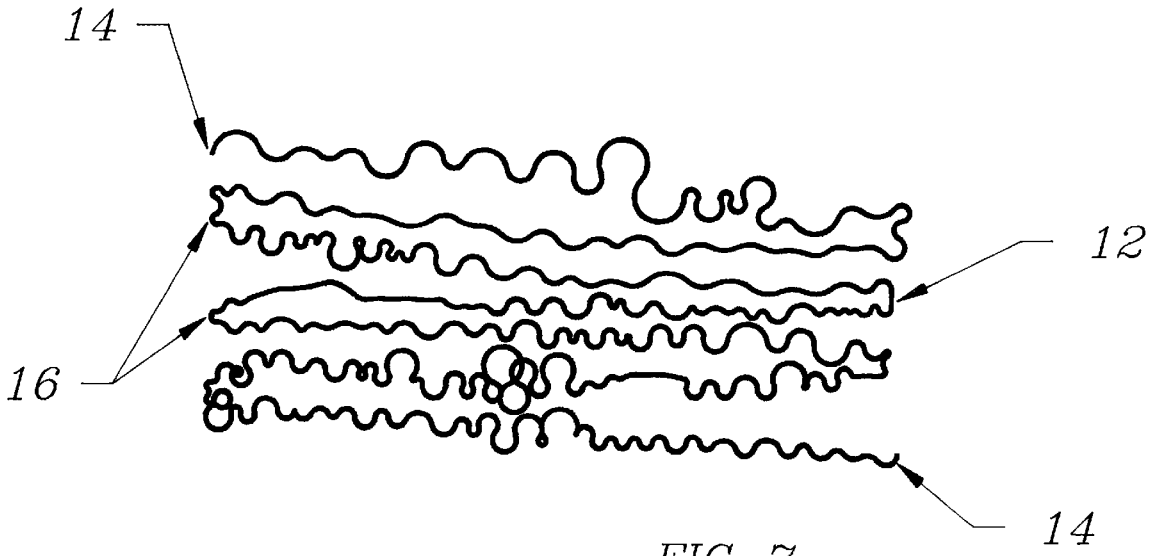
FIG. 7 is a front view of a decorative grass product, according to the present invention.
Figure 8:
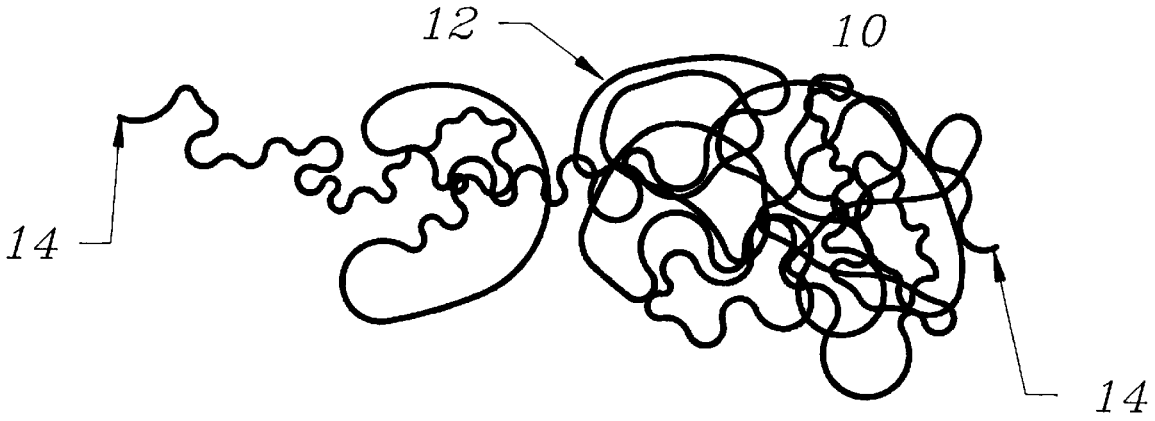
FIG. 8 is a front view of the embodiment of the present invention shown in FIG. 7, with the single strand crumpled to form a decorative grass nest.
Figure 9:
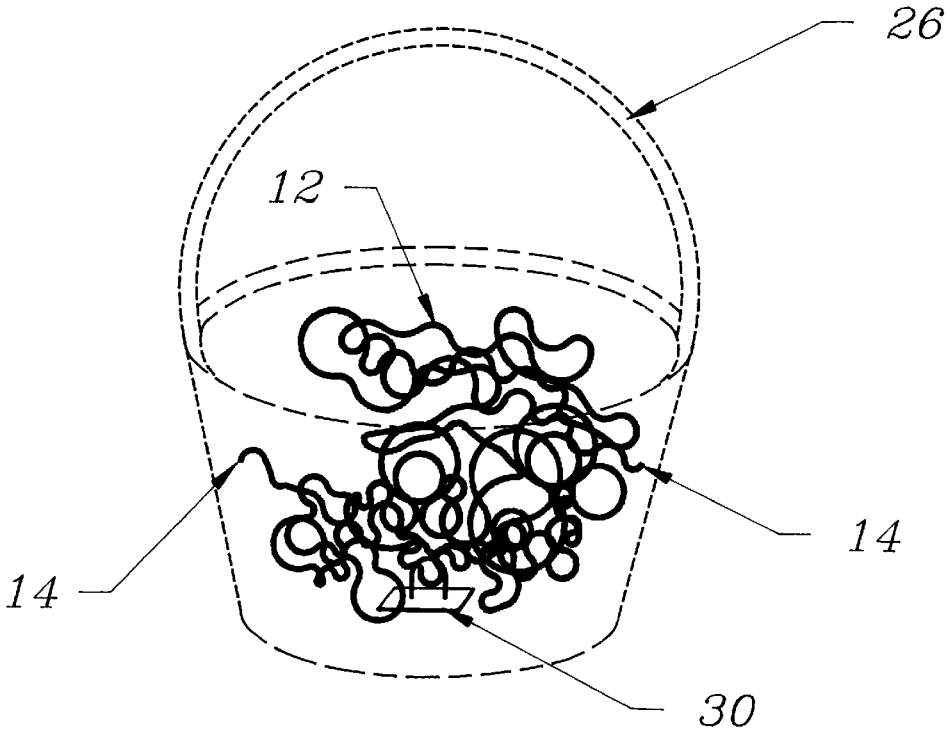
FIG. 9 is a cut-away view of a decorative grass product attached to a basket container, according to the present invention.
Figure 11:
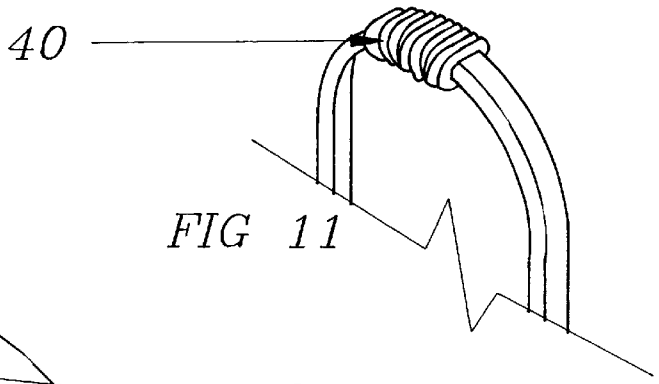
FIG. 11 is a cut-away view depicting a method of attaching a decorative grass product according to the present invention.

Alternatively, a decorative grass product which is not subject to loss of individual strands may consist of a single elongated strand 12 as shown in FIG. 7. The single strand 12 should ideally be longer than typical decorative grass strands, which is to say longer than twenty inches. The length of the single strand 12 should be chosen based on the amount of bulk desired for the decorative grass 10 to be formed from the single strand 12. Once the single strand 12 is crumpled as shown in FIG. 8, it can create a decorative grass nest from the single strand 12, so no separate strands exist which may become lost from the decorative grass 10. When the decorative grass 10 made from a single strand 12 is placed in a container 26, as shown in FIG. 9, it is possible to attach the strand 12 to the container 26 by a mechanical clamp 30 or by some method of adhesion.

The invention has been described in detail with particular reference to preferred embodiments thereof. As will be apparent to those skilled in the art in the light of the accompanying disclosure, many alterations, substitutions, modifications, and variations are possible in the practice of the invention without departing from the spirit and scope of the invention.

I claim:

1. A product for use in filling a container, comprising:

a. a plurality of thin strands of material, each strand having two ends and a middle section, and b. strand connecting means for holding said strands together at said middle section of each strand, and c. said strand connecting means being interior of said container when said strands are placed in said container, so that said strands may obscure said strand connecting means from view.

2. A product as described in claim 1, wherein said strand connecting means comprises an adhesive which causes said strands to adhere together at said middle section.

3. A product as described in claim 1, wherein:

a. each said strand is constructed of an organic polymer which becomes sticky when heated, and b. said strand connecting means comprises fusing said strands at said middle section by heating said organic polymer to cause said strands to adhere together.

4. A product as described in claim 1, wherein said strand connecting means comprises a clamp snugly surrounding said strands at each said middle section.

5. A product as described in claim 1, further comprising:

container attachment means for attaching said strands to said container at each said middle section.

6. A product as described in claim 5, wherein said strand connecting means and said container attachment means comprise a clamp snugly surrounding said strands at each said middle section and surrounding a component of said container.

7. A product as described in claim 5, wherein said container attachment means further comprises:

a. a pad having a top, bottom, and slit formed therein, b. a tie having two ends and a middle section, with said middle section extending upwards from said top of said pad, and said ends extending downward through said slit and from said bottom of said pad, c. wherein said tie holds said strands tightly against said pad when said ends are pulled tightly downwards through said slit, and d. wherein said bottom of said pad is connected to said container.

8. A product as described in claim 7, wherein said tie further comprises a plurality of jagged edges for engaging said strands.

9. A product as described in claim 7, further comprising adhesive applied to said bottom of said pad, causing said pad to adhere to said container.

10. A product as described in claim 7, further comprising adhesive applied to said top of said pad.

11. A product as described in claim 1 for use in filling a container, comprising:

at least one thin strand of material, having two ends and a middle section, said stand being more than 20 inches long, said strand being crumpled to fit within said container.

12. A product as described in claim 11, further comprising:

container attachment means for attaching said strand to said container.

13. A product as described in claim 1, wherein:

each strand has a length greater than five centimeters.

14. A product as described in claim 13, wherein:

each strand has a density greater than 30 denier.

* * * * *